US007685848B2

(12) United States Patent
Jeong et al.

(10) Patent No.: US 7,685,848 B2
(45) Date of Patent: Mar. 30, 2010

(54) LAUNDRY TREATMENT APPARATUS

(75) Inventors: Seong Hae Jeong, Changwon-si (KR); Hye Sun Jung, Masan-si (KR); Hung Myong Cho, Kimhae-si (KR)

(73) Assignee: LG Electronics Inc., Seoul (KR)

( * ) Notice: Subject to any disclaimer, the term of this patent is extended or adjusted under 35 U.S.C. 154(b) by 670 days.

(21) Appl. No.: 11/437,867

(22) Filed: May 22, 2006

(65) Prior Publication Data

US 2007/0119216 A1 May 31, 2007

(30) Foreign Application Priority Data

May 23, 2005 (KR) ..... 10-2005-0043190
May 23, 2005 (KR) ..... 10-2005-0043191

(51) Int. Cl.
*D06F 29/00* (2006.01)

(52) U.S. Cl. ..... 68/3 R; 68/19.1; 68/20

(58) Field of Classification Search ..... 68/19.1, 68/20, 3 R
See application file for complete search history.

(56) References Cited

U.S. PATENT DOCUMENTS

| | | | | | |
|---|---|---|---|---|---|
| 2,566,488 | A | * | 9/1951 | Gould | 68/20 |
| 2,816,429 | A | * | 12/1957 | Kurlancheek | 68/19.2 |
| 2,866,273 | A | * | 12/1958 | Geldhof | 34/75 |
| 4,535,610 | A | * | 8/1985 | Fey et al. | 68/3 R |
| 4,663,538 | A | * | 5/1987 | Cotton et al. | 307/38 |
| 4,680,948 | A | * | 7/1987 | Rummel et al. | 68/3 R |
| 4,821,535 | A | * | 4/1989 | Wassilak et al. | 68/3 R |
| 5,653,416 | A | * | 8/1997 | Frank | 248/682 |
| 2005/0139738 | A1 | * | 6/2005 | Hwang et al. | 248/188.1 |

FOREIGN PATENT DOCUMENTS

| | | | |
|---|---|---|---|
| AT | 361 431 | | 3/1981 |
| CA | 2171400 | * | 9/1996 |
| CA | 2 245 442 | * | 4/1999 |
| DE | 32 13 420 | * | 10/1983 |
| DE | 3213420 A1 | | 10/1983 |
| DE | 3827789 A1 | | 2/1990 |
| DE | 42 33 803 | * | 4/1994 |
| DE | 33 29 615 | * | 2/1995 |

(Continued)

OTHER PUBLICATIONS

European Patent Office 0 463 576 Jan. 1992.*

(Continued)

*Primary Examiner*—Frankie L Stinson
(74) *Attorney, Agent, or Firm*—McKenna Long & Aldridge LLP

(57) ABSTRACT

The present invention relates to a laundry treatment apparatus. According to an embodiment of the present invention, the laundry treatment apparatus includes shield means that shields the gap between a plurality of laundry treatment apparatus main bodies and a gap between a laundry treatment apparatus main body and a pedestal. Accordingly, there is an advantage in that the market quality can be enhanced since the togetherness and beauty of products are improved. Furthermore, the shield means includes a fixed part that fixes the laundry treatment apparatus main body disposed on an upper side. Accordingly, there is an advantage in that the laundry treatment apparatus main body can be fixed in a stable way.

6 Claims, 12 Drawing Sheets

FOREIGN PATENT DOCUMENTS

| | | | |
|---|---|---|---|
| DE | 198 48 875 | * | 4/2000 |
| DE | 20 101 254 | * | 4/2001 |
| DE | 20 205 628 | * | 4/2002 |
| FR | 2 672 9620 | * | 8/1992 |
| GB | 2 116 622 | * | 9/1983 |
| JP | 53-232595 | * | 12/1984 |
| JP | 2006 026400 | * | 2/2006 |

OTHER PUBLICATIONS

European Patent Office 1 369 523 May 2003.*
European Patent Offic e 0 618 322 Oct. 1994.*

* cited by examiner

LAUNDRY TREATMENT APPARATUS

This application claims the benefit of Korean Patent Application No. 2005-43190, filed on May 23, 2005 and Korean Patent Application No. 2005-43191, filed on May 23, 2005, which are hereby incorporated by reference for all purposes as if fully set forth herein.

BACKGROUND

1. Field of the Invention

The present invention relates to a laundry treatment apparatus. More particularly, the present invention relates to a laundry treatment apparatus, in which in the case where a plurality of laundry treatment apparatus main bodies or a laundry treatment apparatus main body and a pedestal are loaded, loaded matters can be stably fixed mutually and a gap therebetween can be shielded.

2. Discussion of Related Art

In general, a laundry treatment apparatus may be classified into a washing machine for removing pollutant adhered on clothes, bedclothes, and so on (hereinafter, referred to as "fabric") using water, a detergent, mechanical action, and the like, a drying machine that dries wet fabric using dried hot air heated by the heater, mechanical action, and so on, and a combination dry and washing machine serving as both the washing function and the dry function.

In the laundry treatment apparatus, a plurality of washing machines, drying machines, and combination dry and washing machines can be installed separately at different places. However, they are installed at the same place for the purpose of the continuity and convenience in its processing. Recently, there is a tendency that the plurality of washing machines are installed at the public facilities such as laundry rooms and residence halls.

The plurality of laundry treatment apparatuses may be installed in parallel right and left or may be installed up and down.

If the plurality of laundry treatment apparatuses are installed up and down with them being loaded, an installation area can be minimized and the utilization of the indoor space can be improved accordingly.

FIG. 1 is a perspective view of a laundry treatment apparatus in the related art. FIG. 2 is a front view of the laundry treatment apparatus in the related art.

As shown in FIGS. 1 and 2, the related art laundry treatment apparatus 1 includes a washing machine 2, and a drying machine 4 disposed on a top surface of the washing machine 2.

In general, the washing machine 2 is placed on the ground since it has a heavy weight and great vibration compared with the drying machine 4. In contrast, the drying machine 4 is disposed on a top surface of the washing machine 2 since it has a lightweight and small vibration compared with the washing machine 2.

If the washing machine 2 and the drying machine 4 are installed in up and down directions with them being loaded as described above, the installation area of the laundry treatment apparatus 1 can be minimized, so that the utilization of the indoor space can be improved. Furthermore, use convenience can be enhanced since the washing and dry operations of fabric can be performed coherently by the laundry treatment apparatus 1.

Therefore, in the laundry treatment apparatus 1, after a dirty fabric is input to the washing machine 2, it is washed cleanly by the washing machine 2. Wet fabric washed by the washing machine 2 is drawn from the washing machine 2 and is then input to the drying machine 4 for dry.

In the related art laundry treatment apparatus 1, however, a gap G of a predetermined distance is formed between the washing machine 2 and the drying machine 4. Not only height control legs 6 installed at the bottom of the drying machine 4 are seen, but also foreign substance, such as water and dust, is accumulated on the gap G. Accordingly, a problem arises because the beauty of the laundry treatment apparatus 1 is decreased.

More particularly, the togetherness of the washing machine 2 and the drying machine 4 is degraded because of the gap G between the washing machine 2 and the drying machine 4. This makes the installation structure of the laundry treatment apparatus 1 looks weak overall. Accordingly, it gives a feeling that the drying machine 4 may fall.

Furthermore, if foreign substance is accumulated on the gap G, the foreign substance is adhered to fabric while the fabric washed in the washing machine 2 is moved to the drying machine 4. Accordingly, there is a problem in that washed fabric is again polluted.

SUMMARY OF THE INVENTION

The present invention has been developed in an effort to provide a laundry treatment apparatus, in which it can obviate the gap between a plurality of laundry treatment apparatus main bodies and the gap between the laundry treatment apparatus and a pedestal, thereby improving the stability and beauty.

According to an aspect of the present invention, there is provided a laundry treatment apparatus, including a plurality of laundry treatment apparatus main bodies disposed in up and down directions, and shield means disposed between the plurality of laundry treatment apparatus main bodies, for shielding a gap between the plurality of laundry treatment apparatus main bodies.

Each of the plurality of laundry treatment apparatus main bodies may include a washing machine in which fabric is washed, and a drying machine disposed on a top surface of the washing machine, for drying wet fabric.

The shield means may be a stacking kit. The stacking kit is disposed on a top surface of a laundry treatment apparatus main body located at the lower side, of the plurality of laundry treatment apparatus main bodies, and fixes a laundry treatment apparatus main body located at the upper side, of the plurality of laundry treatment apparatus main bodies.

The stacking kit may include a fixed part that is disposed on a top surface of the laundry treatment apparatus main body located at the lower side, of the plurality of laundry treatment apparatus main bodies, and serves to prevent the movement of the laundry treatment apparatus main body located at the upper side, of the plurality of laundry treatment apparatus main bodies; and a shield unit provided in the fixed part, for shielding a gap between the plurality of laundry treatment apparatus main bodies.

The shield means may be a plate-type member that is formed to have the same height as that of the gap between the plurality of laundry treatment apparatus main bodies and is disposed on the same plane as that of an outer surface of each of the plurality of laundry treatment apparatus main bodies.

According to another aspect of the present invention, there is provided a laundry treatment apparatus, including a laundry treatment apparatus main body, a pedestal disposed on at least one of an upper side and a lower side of the laundry treatment apparatus main body, and shield means disposed between the laundry treatment apparatus main body and the pedestal, for shielding a gap between the laundry treatment apparatus main body and the pedestal.

The laundry treatment apparatus main body may be any one of a washing machine, a drying machine, and a combination dry and washing machine, and is disposed on at top surface of the pedestal.

The shield means may be a shield rib projected from at least one side of the pedestal.

The shield means may be a shield panel installed on at least one side of the pedestal.

According to further another aspect of the present invention, there is provided a laundry treatment apparatus, including a plurality of laundry treatment apparatus main bodies disposed in up and down directions, a pedestal disposed on at least one of an upper side and a lower side of the laundry treatment apparatus main body, first shield means disposed between the plurality of laundry treatment apparatus main bodies, for shielding a gap between the plurality of laundry treatment apparatus main bodies, and second shield means disposed between the laundry treatment apparatus main body and the pedestal, for shielding a gap between the laundry treatment apparatus main body and the pedestal.

The laundry treatment apparatus according to an embodiment of the present invention includes shield means for shielding the gap between the plurality of laundry treatment apparatus main bodies and the gap between the laundry treatment apparatus main body and the pedestal. Accordingly, there is an advantage in that togetherness between products and the beauty can be improved and the market quality can be enhanced.

Furthermore, the shield means disposed between the plurality of laundry treatment apparatus main bodies includes a fixed part for fixing a laundry treatment apparatus main body disposed on an upper side. Accordingly, there is an advantage in that the laundry treatment apparatus main body can be fixed stably.

Furthermore, the shield means disposed between the plurality of laundry treatment apparatus main bodies includes a shield unit for shielding the gap between the plurality of laundry treatment apparatus main bodies. The shield unit is formed at the same height as that of the gap. Accordingly, the shield unit serves to support a laundry treatment apparatus main body located on an upper side. Accordingly, there is an advantage in that the installation stability can be improved.

Furthermore, the shield means disposed between the laundry treatment apparatus main body and the pedestal also serves to support the laundry treatment apparatus main body. Accordingly, there is an advantage in that the installation stability of the laundry treatment apparatus main body can be improved.

In addition, a phenomenon in which foreign substance is accumulated on the gap can be prevented. Accordingly, there is another advantage in that fabric can be prevented from being polluted by foreign substance accumulated on the gap.

BRIEF DESCRIPTION OF THE DRAWINGS

A more compete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

In the following detailed description, only certain exemplary embodiments of the present invention have been shown and described simply by way of illustration.

Figure 1:
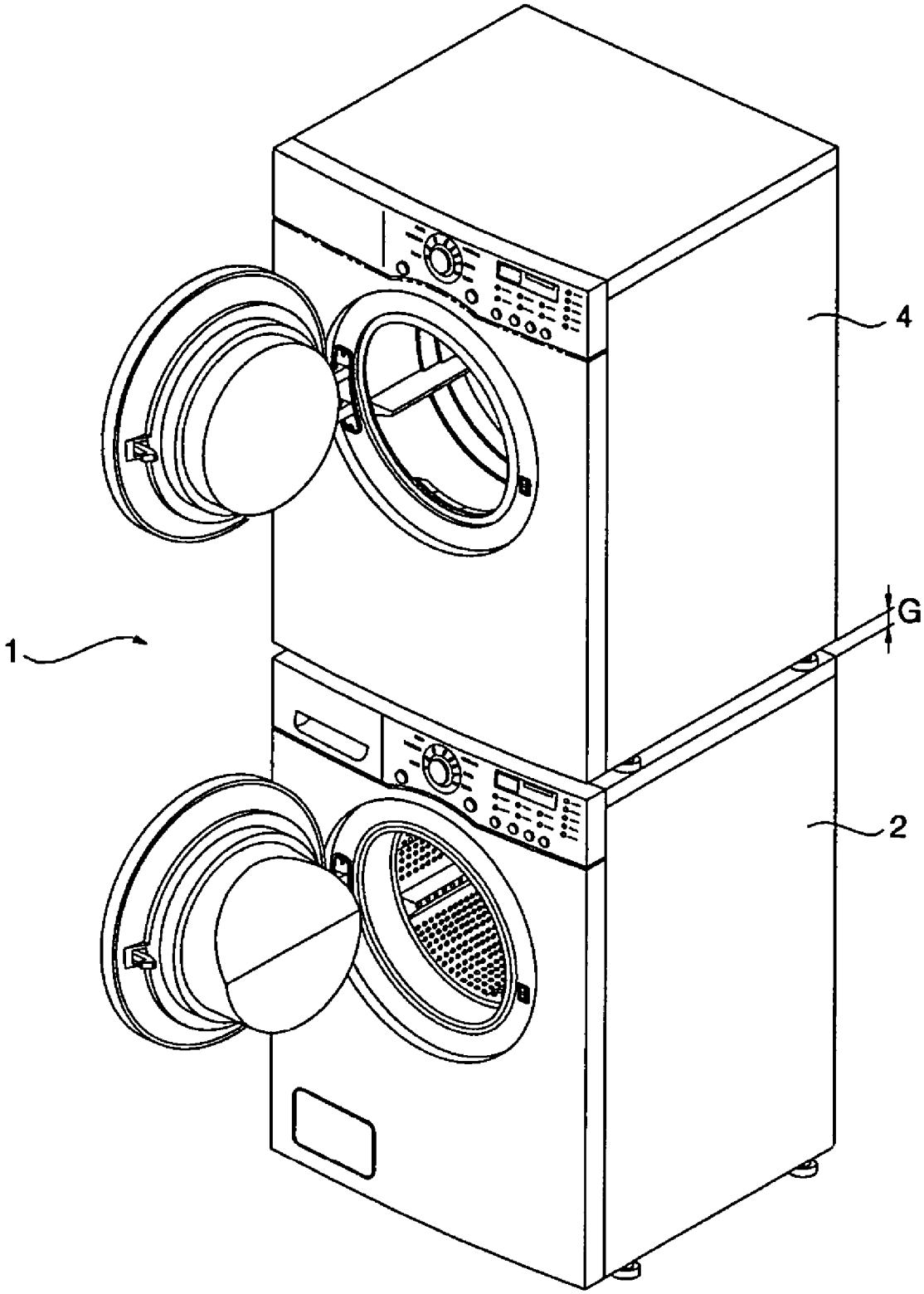
FIG. 1 (related art)
FIG. 1 is a perspective view of a laundry treatment apparatus in the related art.
Figure 2:
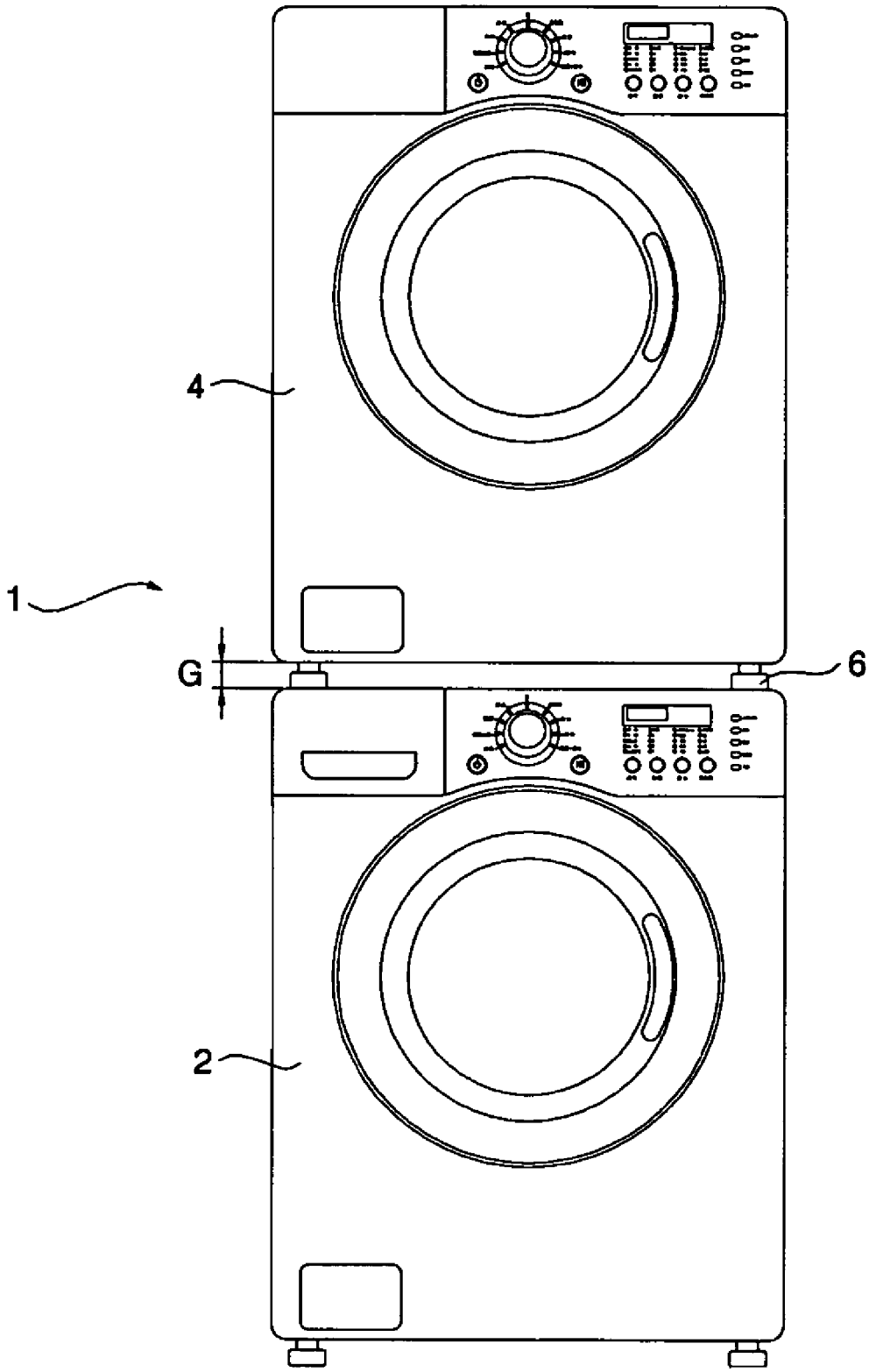
FIG. 2 (related art)
FIG. 2 is a front view of the laundry treatment apparatus in the related art.
Figure 3:
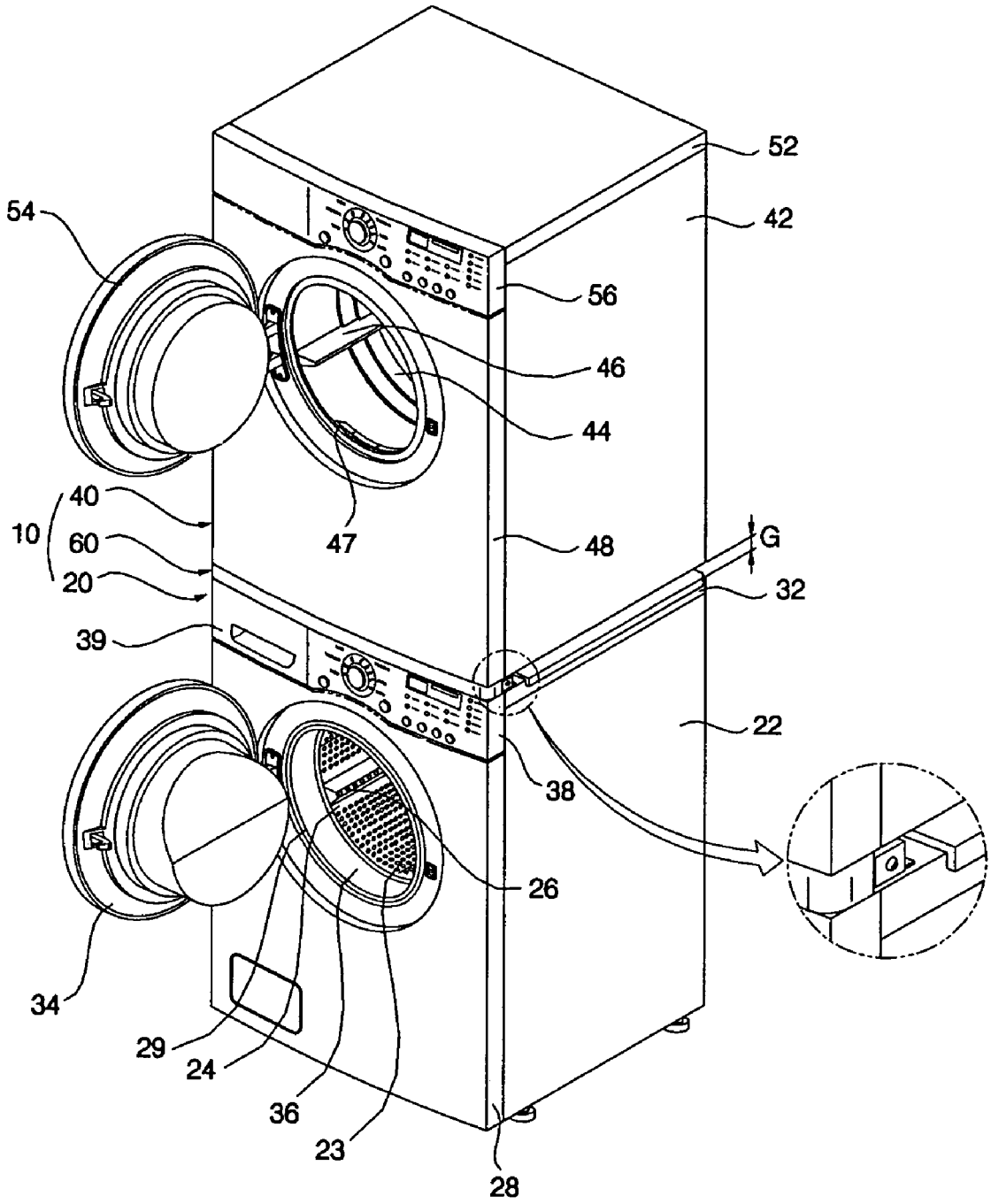
FIG. 3 is a perspective view of a laundry treatment apparatus according to a first embodiment of the present invention.
Figure 4:
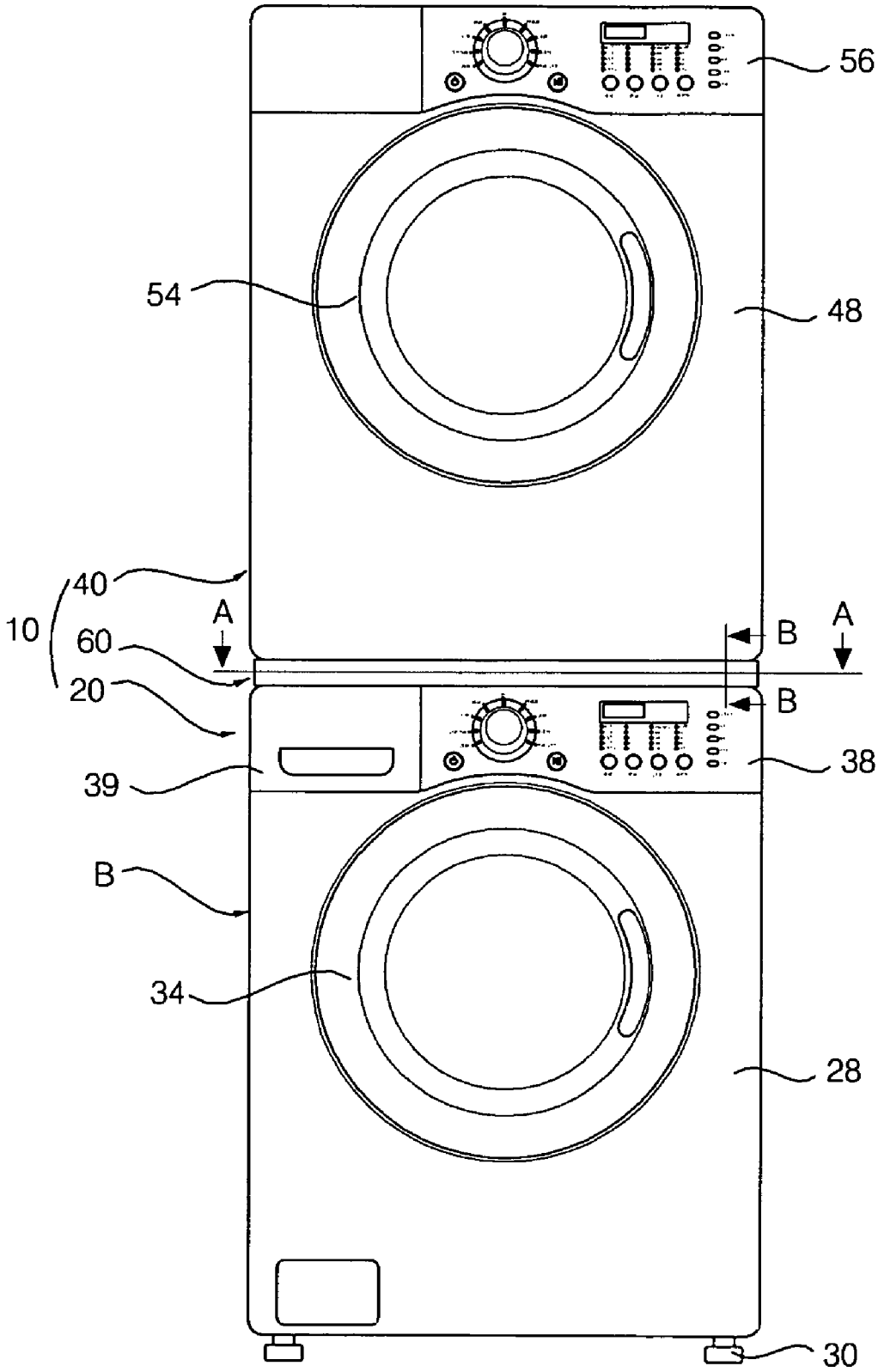
FIG. 4 is a front view of the laundry treatment apparatus according to a first embodiment of the present invention.
Figure 5:
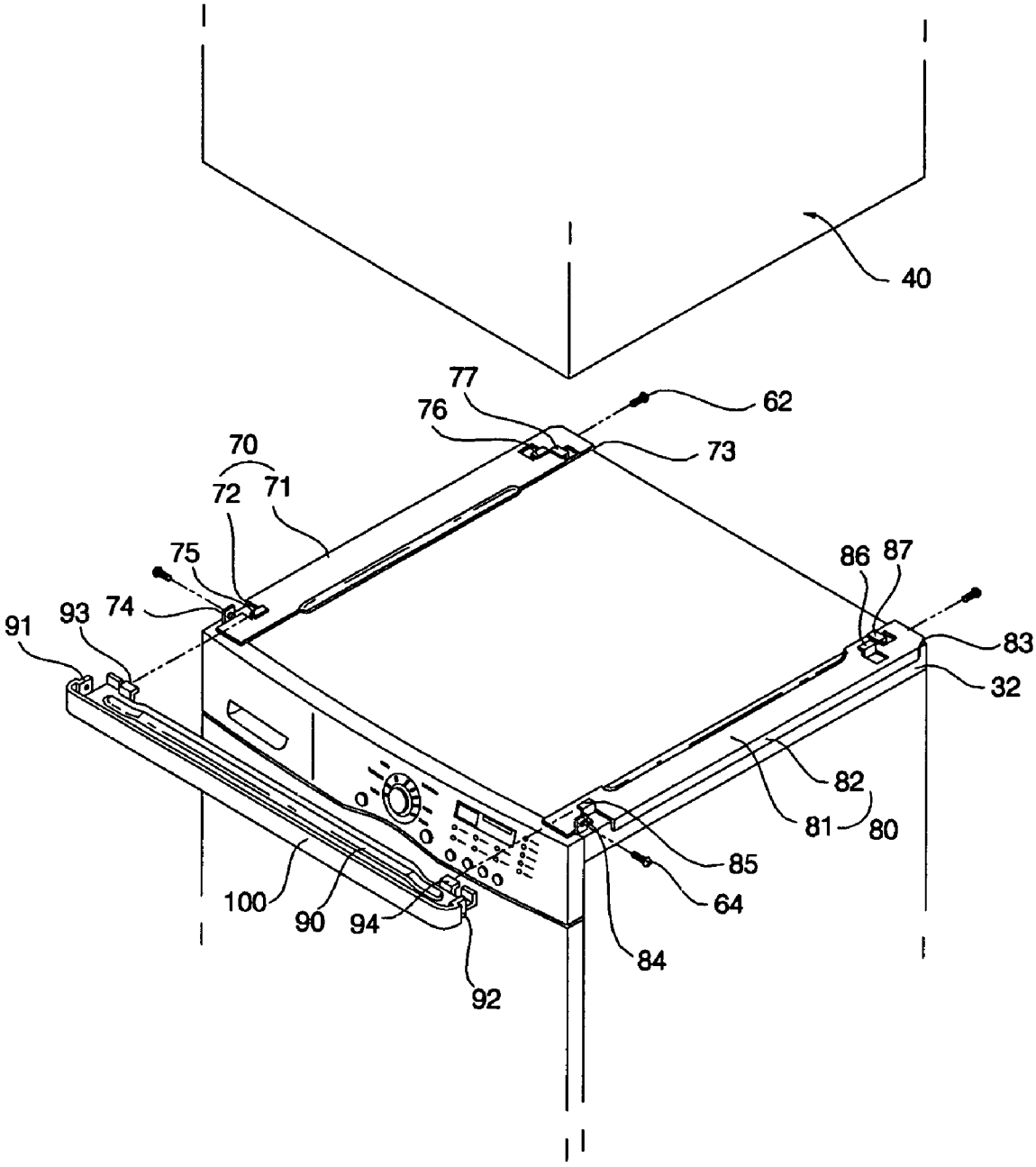
FIG. 5 is a dismantled perspective view of the laundry treatment apparatus according to a first embodiment of the present invention.
Figure 6:
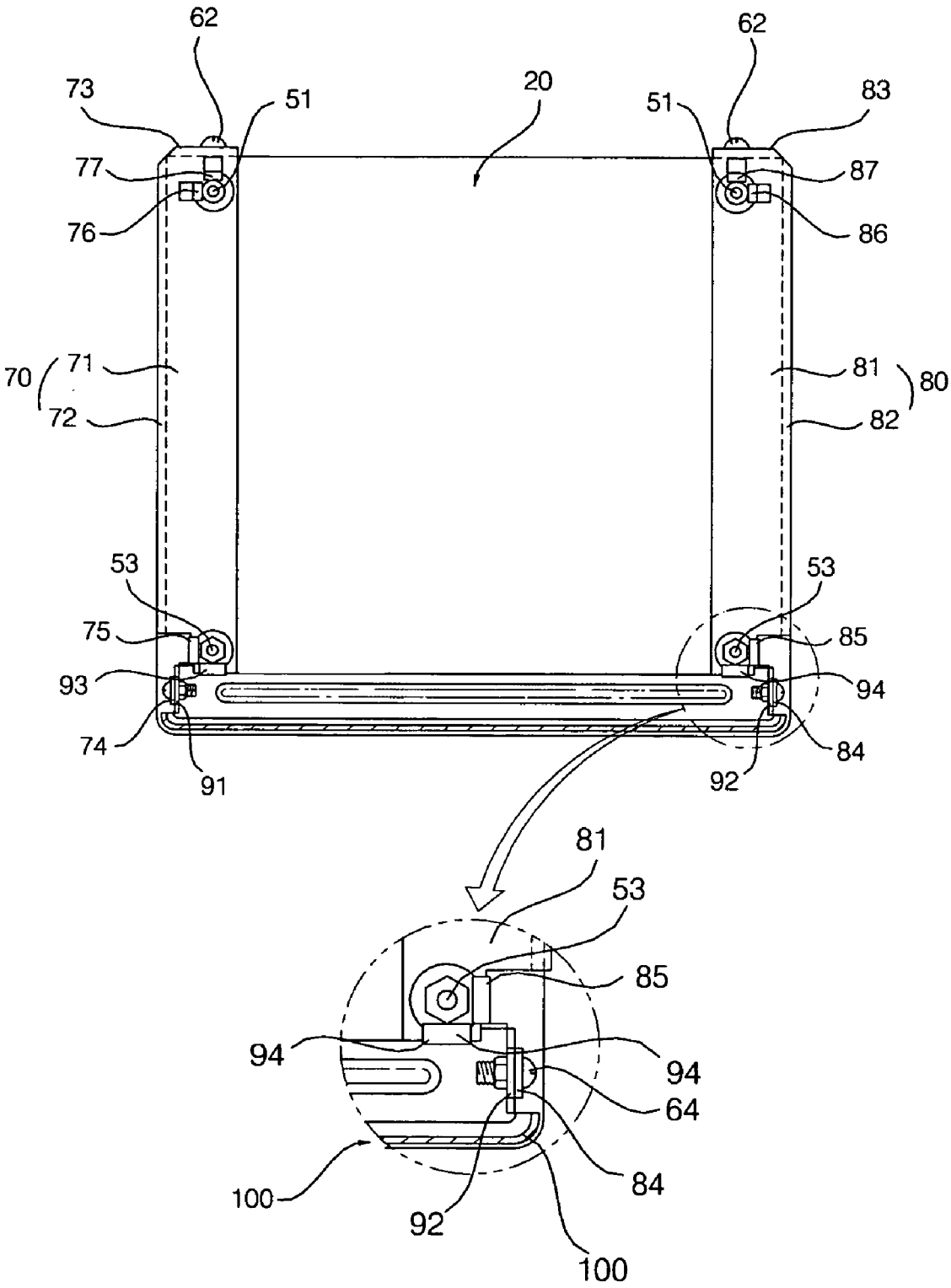
FIG. 6 is a cross-sectional view of the laundry treatment apparatus taken along line A-A in FIG. 4.
Figure 7:
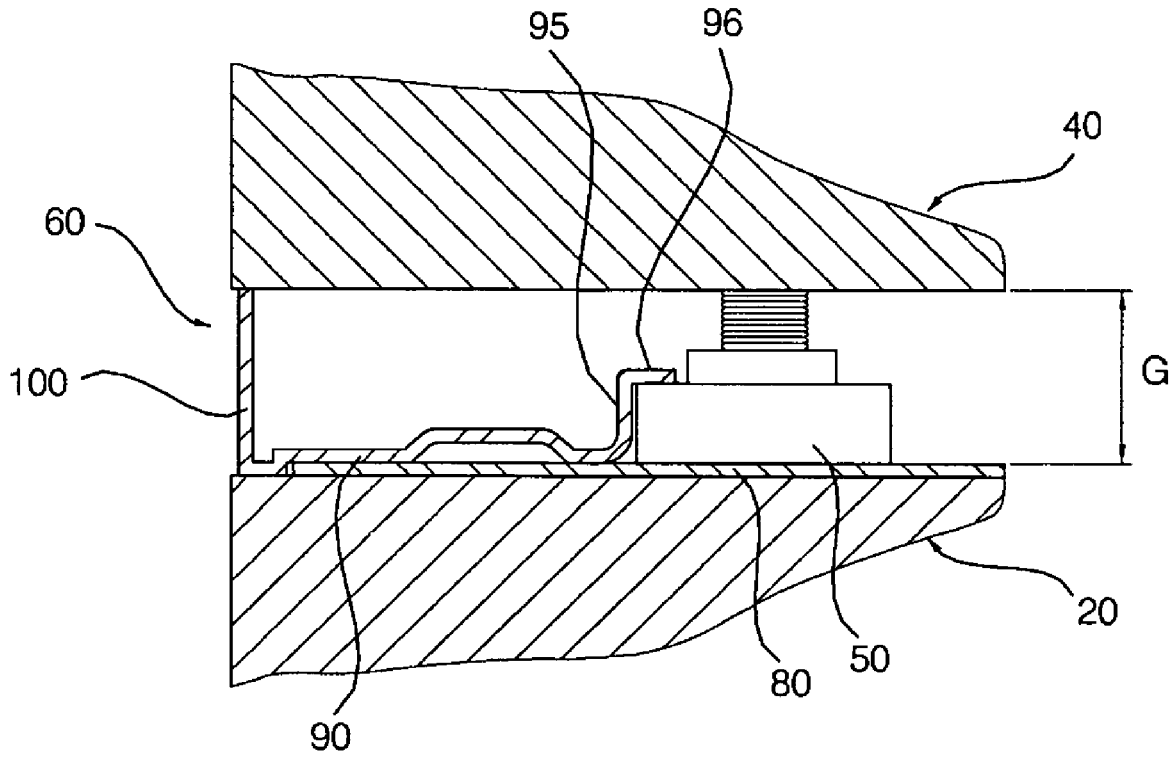
FIG. 7 is a cross-sectional view of the laundry treatment apparatus taken along line B-B in FIG. 4.

FIG. 3 is a perspective view of a laundry treatment apparatus according to a first embodiment of the present invention. FIG. 4 is a front view of the laundry treatment apparatus according to a first embodiment of the present invention. FIG. 5 is a dismantled perspective view of the laundry treatment apparatus according to a first embodiment of the present invention. FIG. 6 is a cross-sectional view of the laundry treatment apparatus taken along line A-A in FIG. 4. FIG. 7 is a cross-sectional view of the laundry treatment apparatus taken along line B-B in FIG. 4.

As shown in FIGS. 3 and 4, the laundry treatment apparatus according to a first embodiment of the present invention includes a plurality of laundry treatment apparatus main bodies disposed up and down, and shield means disposed between the plurality of laundry treatment apparatus main bodies, for shielding a gap between the plurality of laundry treatment apparatus main bodies.

The laundry treatment apparatus main body includes a washing machine, a drying machine, and a combination dry and washing machine. In the present embodiment, it is assumed that the laundry treatment apparatus main body includes the washing machine 20 for washing polluted fabric, and the drying machine 40 disposed on a top surface of the washing machine 20, for drying wet fabric.

The washing machine 20 includes a cabinet for washing 22, a tub (not shown) horizontally disposed within the cabinet for washing 22, for containing water, a drum for washing 24, which is disposed pivotally within the tub and contains polluted fabric, a plurality of lifters for washing 26 disposed on an inner surface of the drum for washing 24, for drawing up the fabric so that the fabric can drop from a predetermined height by the gravity, and a motor for washing (not shown), which is disposed at the rear of the tub and rotates the drum for washing 24. A plurality of through holes 23 through which water and/or bubbles can pass are formed at the outer surface of the drum for washing 24.

A cabinet for washing cover 28 is mounted on the entire surface of the cabinet for washing 22. Height control legs for washing 30 whose heights can be controlled are installed at four lower corners of the cabinet for washing 22, respectively. A top plate for washing 32 is disposed on a top surface of the cabinet for washing 22.

In the cabinet for washing cover 28 are formed not only a laundry inlet port 29 through which the fabric can enter the drum for washing 24, but also a door for washing 34 for opening and shutting the laundry inlet port 29, which is pivotally disposed. A gasket 36 for mitigating the shock by the rotation of the drum for washing 24 and also serving to prevent water from overflow externally is installed between the tubs.

A control panel for washing 38 for controlling the driving of the washing machine 20 and also displaying the driving state of the washing machine 20 to the outside is disposed at an upper side of the cabinet for washing cover 28. A detergent box 39 through which a detergent is input is installed at one side of the control panel for washing 38 so that it can be drawing.

Furthermore, the drying machine 40 includes a cabinet for dry 42 forming an external appearance, a drum for dry 44 pivotally disposed within the cabinet for dry 42, a plurality of lifters for dry 46 disposed on an inner surface of the drum for dry 44, for drawing up fabric so that the fabric can drop from a predetermined height by the gravity, a heater (not shown) and a ventilator (not shown) disposed outside the drum for dry 44 in such a way to communicate with the drum for dry 44, for supplying dried hot air to the inside of the drum for dry 44, and a motor for dry (not shown) for driving the ventilator and rotating the drum for dry 44. The drum for dry 44 contains wet fabric and has front and rear surfaces opened.

A cabinet for dry cover 48 is disposed on the font surface of the cabinet for dry 42. Height control legs for dry whose height can be controlled 50 are disposed at four lower corners of the cabinet for dry 42, respectively. A top plate for dry 52 is disposed on a top surface of the cabinet for dry 42.

A dry water inlet port 47 through which fabric can enter the drum for dry 44 is formed at the cabinet for dry cover 48. A door for dry 54 that opens and shuts the dry water inlet port 47 is pivotally formed in the cabinet for dry cover 48. Furthermore, a control panel for dry 56 for controlling the driving of the drying machine 40 and displaying the driving state of the drying machine 40 to the outside is disposed at an upper side of the cabinet for dry cover 48.

A front supporter (not shown) that pivotally supports the front side of the drum for dry 44 is disposed on a rear surface of the cabinet for dry cover 48. A rear supporter (not shown) that pivotally supports the rear side of the drum for dry 44 is mounted on the rear surface of the cabinet for dry 42.

On the other hand, the shield means is a stacking kit 60 disposed on the top surface of the washing machine 20, for fixing the drying machine 40.

The stacking kit 60 is disposed on the top surface of the washing machine 20, the stacking kit 60 includes a fixed part formed to prevent the movement of the drying machine 40, and a shield unit provided in the fixed part, for shielding a gap G between the washing machine 20 and the drying machine 40.

In more detail, as shown in FIG. 6, the fixed part of the stacking kit 60 includes a left fixed part 70 disposed on the upper left side of the washing machine 20, for preventing the left and backward movements of the drying machine 40, a right fixed part 80 disposed on the upper right side of the washing machine 20, for preventing the right and backward movements of the drying machine 40, and a front-side fixed part 90 disposed at the upper front side of the laundry treatment apparatus main body and connected to anterior portions of the left fixed part 70 and the right fixed part 80 in order to prevent the forward movement of the drying machine 40.

The left fixed part 70 and the right fixed part 80 are plate-type members made of a metal material, which are processed to have a L-shaped cross section though stamping. The left fixed part 70 and the right fixed part 80 surround the left and left corners of the top plate for washing 32, respectively, and are disposed on the washing machine 20. The height control legs for dry 50 of the drying machine 40 is seated on top surfaces of the left fixed part 70 and the right fixed part 80.

That is, the left and right fixed parts 70 and 80 includes left and right horizontal panels 71 and 81 covered on the upper left side and the upper right side of the top plate for washing 32, respectively, wherein the height control legs for dry 50 respectively disposed on the left and right sides of the drying machine 40 are seated on the top surfaces of the left and right horizontal panels 71 and 81, and left and right vertical panels 72 and 82, which are downwardly curved from the left end of the left horizontal panel 71 and the right end of the right horizontal panel 81, respectively, and is covered on the left top surface and the right top surface of the top plate for washing 32, respectively.

Bottom surfaces of the left and right horizontal panels 71 and 81 are adhered to the top surface of the top plate for washing 32 by means of adhesives such as a both-sided tape.

First fastening units 73 and 83 that are downwardly curved toward the rear side of the top plate for washing 32 are formed in the rear side of the top plate for washing 32 so that they can be fastened to rear sides of the left and right horizontal panels 71 and 81 by means of a fastening member 62. The fastening holes are formed in the first fastening units 73 and 83*a* and the top plate for washing 32, respectively in a corresponding manner.

On the other hand, second fastening units 74 and 84 fastened to the front-side fixed part 90 are formed at the upper front sides of the left and right horizontal panels 71 and 81, respectively. First fixed projections 75 and 85 are formed to prevent right and left movements of the height control legs for dry 50 disposed at the front of the drying machine 40.

In addition, second fixed projections 76 and 86 and third fixed projections 77 and 87, for preventing the right and left movements and the backward movement of the height control legs for dry 50 disposed at the rear of the drying machine 40 are formed at the upper rear sides of the left and right horizontal panels 71 and 81.

The front-side fixed part 90 is plate-type member made of a metal material, which is processed to have a plane shape through stamping. Both sides of the front-side fixed part 90 are upwardly disposed on the front sides of the left and right fixed parts 70 and 80. Both sides of the front-side fixed part 90 are fastened to the left and right fixed parts 70 and 80.

In more detail, third fastening units 91 and 92 are disposed at both sides of the front-side fixed part 90 opposite to the second fastening units 74 and 84 so that they can be fastened to the second fastening units 74 and 84 of the left and right horizontal panels 71 and 81 by means of a fastening member 64. Fourth fixed projections 93 and 94 for preventing the forward movement of the height control legs for dry 50 disposed at the front of the drying machine 40 are formed at both sides of the front-side fixed part 90, respectively.

The first fixed projections 75 and 85, the second fixed projections 76 and 86, the third fixed projections 77 and 87, and the fourth fixed projections 93 and 94 are formed in different directions, but have the same structure.

Furthermore, the front-side fixed part 90 has a front side downwardly curved as much as a thickness of the left and right horizontal panels 71 and 81 of the left and right fixed parts 70 and 80 so that the front side can be closely adhered to the top surface of the washing machine 20.

Meanwhile, the shield unit of the stacking kit 60 is a front shield unit 100 provided in the front-side fixed part 90, for shielding the front gap between the plurality of laundry treatment apparatus main bodies, as shown in FIGS. 6 and 7.

The front shield unit 100 is upwardly curved from the front-side fixed part 90 and is plate-type member that is processed along with the stamping process of the front fixed part 90, as shown in FIG. 6.

The front shield unit 100 has the same height as that of the gap G so that it can support the front side of the drying machine 40.

Furthermore, the front shield unit 100 has the same shape as the front sides of the washing machine 20 and the drying machine 40 and is disposed on the same plane as that of the front sides of the washing machine 20 and the drying machine 40.

An installation process and operation of the laundry treatment apparatus constructed as above according to a first embodiment of the present invention will be described below.

The washing machine 20 is first installed at the installation place of the laundry treatment apparatus 10. The stacking kit 60 is mounted on the washing machine 20. The drying machine 40 is placed on the top surface of the stacking kit 60.

In the stacking kit 60, the left and right fixed parts 70 and 80 are mounted in the top plate for washing 32 of the washing machine 20. The left and right fixed parts 70 and 80 are respectively mounted at the left and right corners of the top plate for washing 32 by means of the both-sided tape adhered on the bottom surfaces of the left and right horizontal panels 71 and 81. The first fastening units 73 and 83 formed at the rear sides of the left and right horizontal panels 71 and 81 are fastened to the rear side of the top plate for washing 32 by means of the fastening member 62.

If the left and right fixed parts 70 and 80 of the stacking kit 60 are disposed on the washing machine 20 as described above, the drying machine 40 is disposed on the washing machine 20 so that the height control legs for dry 50 of the drying machine 40 are inserted between the first fixed projections 75 and 85, the second fixed projections 76 and 86, and the third fixed projections 77 and 87 formed in the left and right horizontal panels 71 and 81 of the left and right fixed parts 70 and 80.

In other words, the rear height control legs 51 of the height control legs for dry 50 of the drying machine 40 are supported by the second fixed projections 76 and 86 and the third fixed projections 77 and 87 so that the left and right and rear sides thereof are closely adhered. Accordingly, the left and right movements and the backward movement of the rear height control legs 51 can be prevented.

In addition, the front height control legs 53 of the height control legs for dry 50 of the drying machine 40 are closely adhered to the right and left sides by means of the first fixed projections 75 and 85 so the right and left movements of the front height control legs 53 can be prevented.

If the drying machine 40 is disposed on the left and right fixed parts 70 and 80, both sides of the front-side fixed part 90 are disposed on the front sides of the left and right fixed parts 70 and 80. The fastening member 64 is fastened to the second fastening units 74 and 84 of the left and right fixed parts 70 and 80 and the third fastening units 91 and 92 of the front-side fixed part 90. Accordingly, the front-side fixed part 90 has both sides fastened to the front sides of the left and right fixed parts 70 and 80.

At this time, the fourth fixed projections 93 and 94 of the front-side fixed part 90 are closely adhered to the front sides of the front height control legs 50B of the height control legs for dry 50 of the drying machine 40, so that the forward movement of the front height control legs 50B can be prevented.

Therefore, a lateral support projection 95 of each of the first fixed projections 75 and 85, the second fixed projections 76 and 86, the third fixed projections 77 and 87, and the fourth fixed projections 93 and 94 prevents the front and rear movements and the left and right movements of the height control legs for dry 50. In addition, a top suspension projection 96 of each of the first fixed projections 75 and 85, the second fixed projections 76 and 86, the third fixed projections 77 and 87, and the fourth fixed projections 93 and 94 prevents the up and down movements of the height control legs for dry 50. Accordingly, the drying machine 40 can be stably fixed on the top surface of the washing machine 20 by means of the stacking kit 60.

Meanwhile, since both sides of the front-side fixed part 90 are fastened to the left and right fixed parts 70 and 80, the front shield unit 100 of the front-side fixed part 90 is located at the front side of the gap G between the drying machine 40 and the washing machine 20, so that the front side of the gap G is shielded by the front shield unit 100.

The front shield unit 100 has the same shape as that of the front surface of the washing machine 20 and the drying machine 40 and is disposed at the same place as that of the washing machine 20 and the drying machine 40. Accordingly, the front sides of the washing machine 20 and the drying machine 40 are consecutively connected by the front shield unit 100, so that the front side of the laundry treatment apparatus 10 can be formed consistently.

More particularly, in the case where washed fabric is to be dried by the washing machine 20, pollutants of the fabric can be shielded by the front shield unit 100 so that foreign substance accumulated on the gap G between the drying machine 40 and the washing machine 20 is not adhered to the fabric while the fabric is drawn from the drum for washing 22 of the washing machine 20 and is then input to the drum for dry 44 of the drying machine 40.

Figure 8:
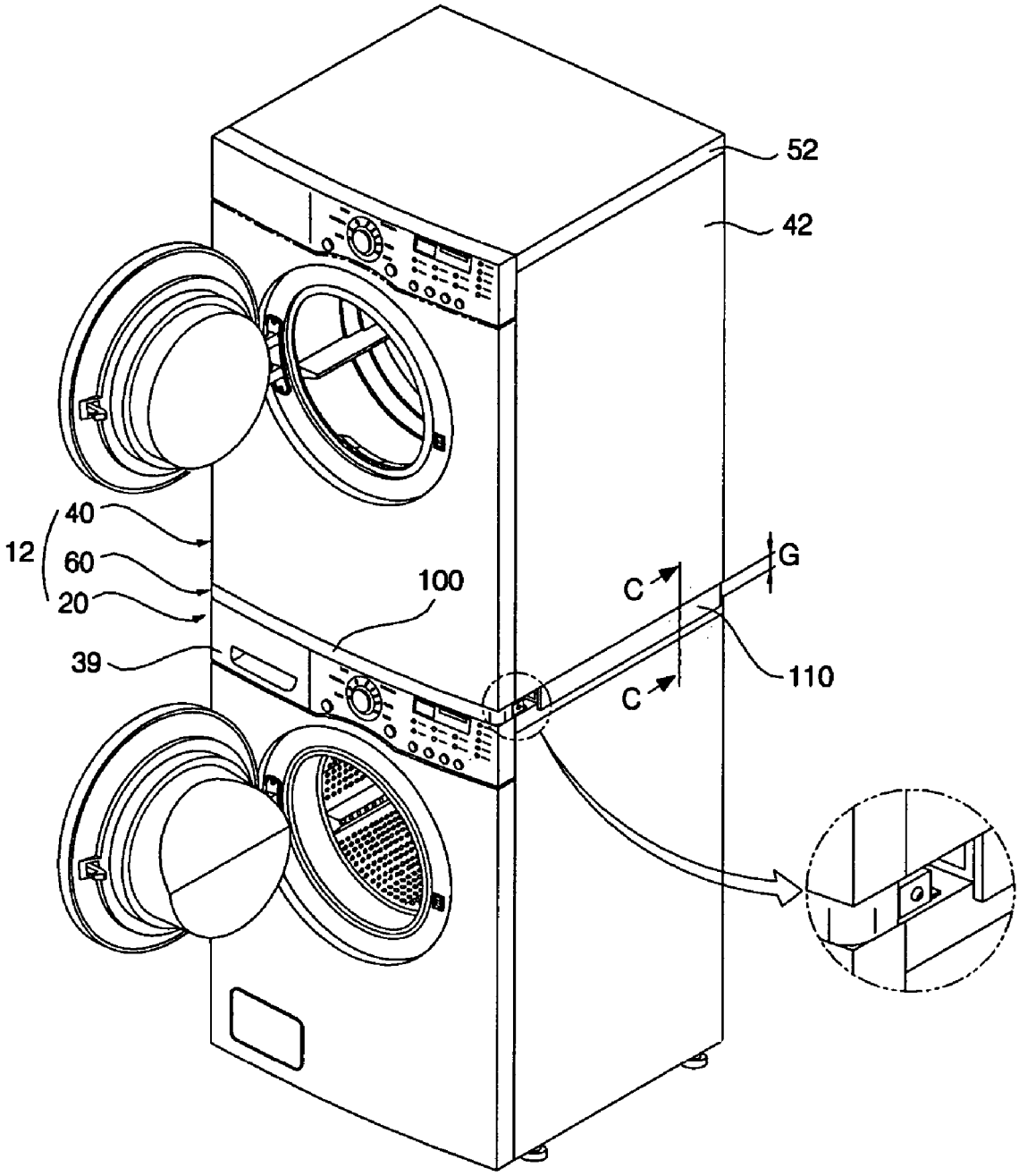
FIG. 8 a perspective view of a laundry treatment apparatus according to a second embodiment of the present invention.
Figure 9:
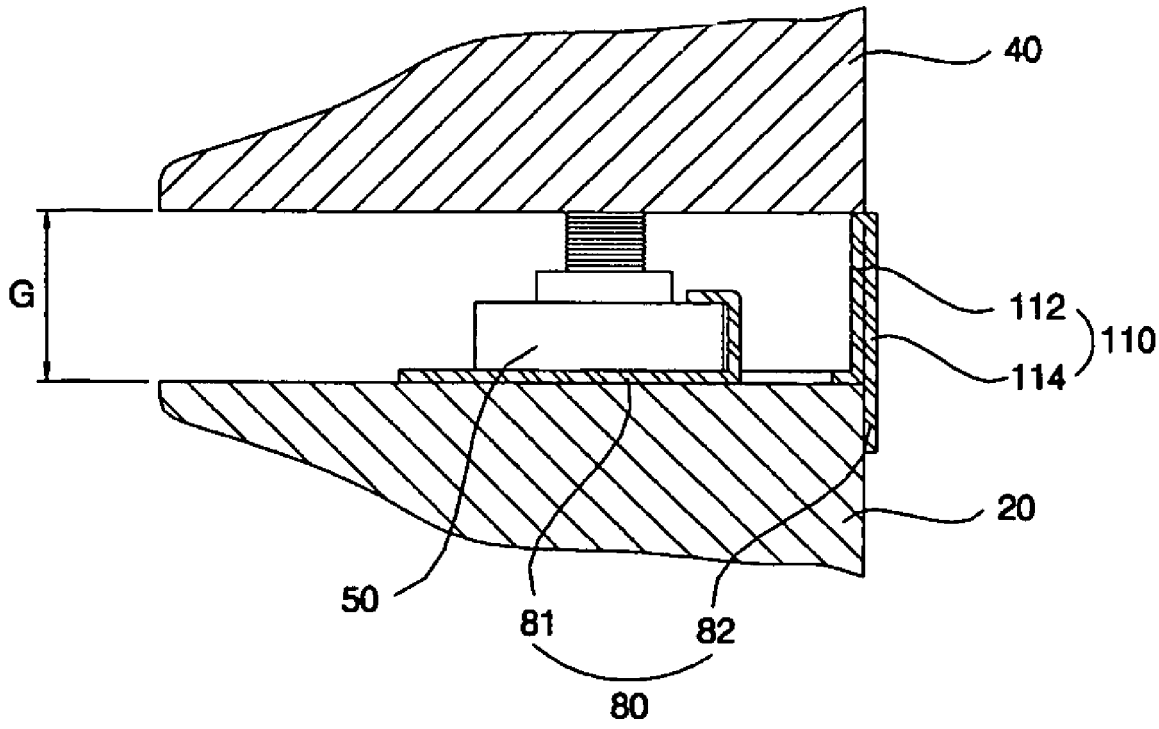
FIG. 9 is a cross-sectional view of the laundry treatment apparatus taken along line C-C in FIG. 8.

FIG. 8 a perspective view of a laundry treatment apparatus according to a second embodiment of the present invention. FIG. 9 is a cross-sectional view of the laundry treatment apparatus taken along line C-C in FIG. 8.

The same reference numbers will be used to refer to the same parts as those of the first embodiment and description thereof will be omitted.

In the laundry treatment apparatus according to a second embodiment of the present invention, a stacking kit 60 is disposed between a washing machine 20 and a drying machine 40, as shown in FIGS. 8 and 9. The stacking kit 60 includes a fixed part disposed on a top surface of the washing machine 20, for preventing the movement of the drying machine 40, and a shield unit provided in the fixed part, for shielding a gap G between the washing machine 20 and the drying machine 40.

The shield unit includes a front shield unit 100 that shields a front gap between the washing machine 20 and the drying machine 40, and lateral shield units 110 shielding a lateral gap. The remaining constituent elements are the same as those of the first embodiment.

In other words, the fixed part of the stacking kit 60 includes a left fixed part 70 disposed on the upper left side of the washing machine 20, for preventing the left and backward movements of the drying machine 40, a right fixed part 80 disposed on the upper right side of the washing machine 20, for preventing the right and backward movements of the drying machine 40, and a front-side fixed part 90 connected to the front sides of the left fixed part 70 and the right fixed part 80, for preventing the forward movement of the drying machine 40.

Furthermore, the shield unit of the stacking kit 60 includes a front shield unit 100 formed at the front side of the front-side fixed part 90 so that the front gap G between the drying machine 40 and the washing machine 20 can be shielded, and lateral shield units 110 formed at the lateral sides of the left fixed part 70 and the right fixed part 80, respectively, so that both lateral gaps G between the drying machine 40 and the washing machine 20 can be shielded.

In this case, the left fixed part 70 includes a left horizontal panel 71, which is mounted to cover the upper left side of the top plate for washing 32 and is seated on the top surface of the height control legs for dry 50 disposed at the right side of the drying machine 40, and a left vertical panel 72, which is downwardly curved from the left end of the left horizontal panel 71 and is mounted to cover the left top surface of the top plate for washing 32.

Furthermore, the right fixed part 80 includes a right horizontal panel 71, which is mounted to cover the right side of the top plate for washing 32 and is seated on the top surfaces of the height control legs for dry 50 disposed at the left side of the drying machine 40, and a right vertical panel 82, which is downwardly curved from the right end of the right horizontal panel 81 and is mounted to cover the right top surface of the top plate for washing 32.

The lateral shield units 110 are plate-type members that are processed along with the stamping of the left and right fixed parts 70 and 80 and are integrally upwardly curved at the left and right vertical panels 72 and 82 of the left and right fixed parts 70 and 80, respectively.

That is, as shown in FIG. 9, each of the lateral shield unit 110 includes a curved part 112 upwardly curved from the left and right ends of the left and right horizontal panels 71 and 81, and a lateral side 114, which is curved downwardly from the front end of the curved part 112 and shields both sides of the gap G between the drying machine 40 and the washing machine 20.

The lateral shield units 110 are formed between the left and right horizontal panels 71 and 81 and the left and right vertical panels 72 and 82.

The lateral shield units 110 are formed to have the same height as that of the gap G so that both sides of the gap G between the washing machine 20 and the drying machine 40 can be shielded and both lateral sides of the drying machine 40 can be supported.

Therefore, in the laundry treatment apparatus 12, not only the entire lower surface and both lateral sides of the drying machine 40 are supported at the same time, but also the front and lateral sides of the gap G between the washing machine 20 and the drying machine 40 can be shielded at the same time, by means of the lateral shield units 110 and the front shield unit 100.

The lateral side 114 of the lateral shield units 110 is formed to have the same shape as that of the lateral sides of the washing machine 20 and the drying machine 40 in a similar way to the front shield unit 100, and is located on the same plane as that of the lateral sides of the washing machine 20 and the drying machine 40.

Accordingly, the front shield unit 100 and the lateral shield units 110 look consecutively connected to the front and both lateral sides of the washing machine 20 and the drying machine 40, thereby improving the togetherness of the laundry treatment apparatus 12.

Although the laundry treatment apparatus of the present invention has been described with reference to the illustrated drawings, it is to be understood that the invention is not limited to the disclosed embodiments, but can be modified in various manners by those skilled in the art within the spirit and scope of the appended claims.

In other words, the front shield member and the lateral shield member may be formed as independent members in order to be installed at the front fixed part and the left and right fixed parts. Furthermore, the front shield member and the lateral shield member may be formed in various shapes from the front fixed part and the left and right fixed parts.

For example, the front shield member may include an extension unit that is upwardly curved in such a way to be closely adhered to the bottom surface of the drying machine and is then extended forwardly, and a front part downwardly curved from the front end of the extension unit. The lateral shield member may include a curved part that is upwardly curved from the lateral sides of the left and right vertical panels in such a way to be closely adhered to the bottom of the drying machine and is then extended laterally, and a lateral part downwardly curved from the front end of the curved part.

Figure 10:
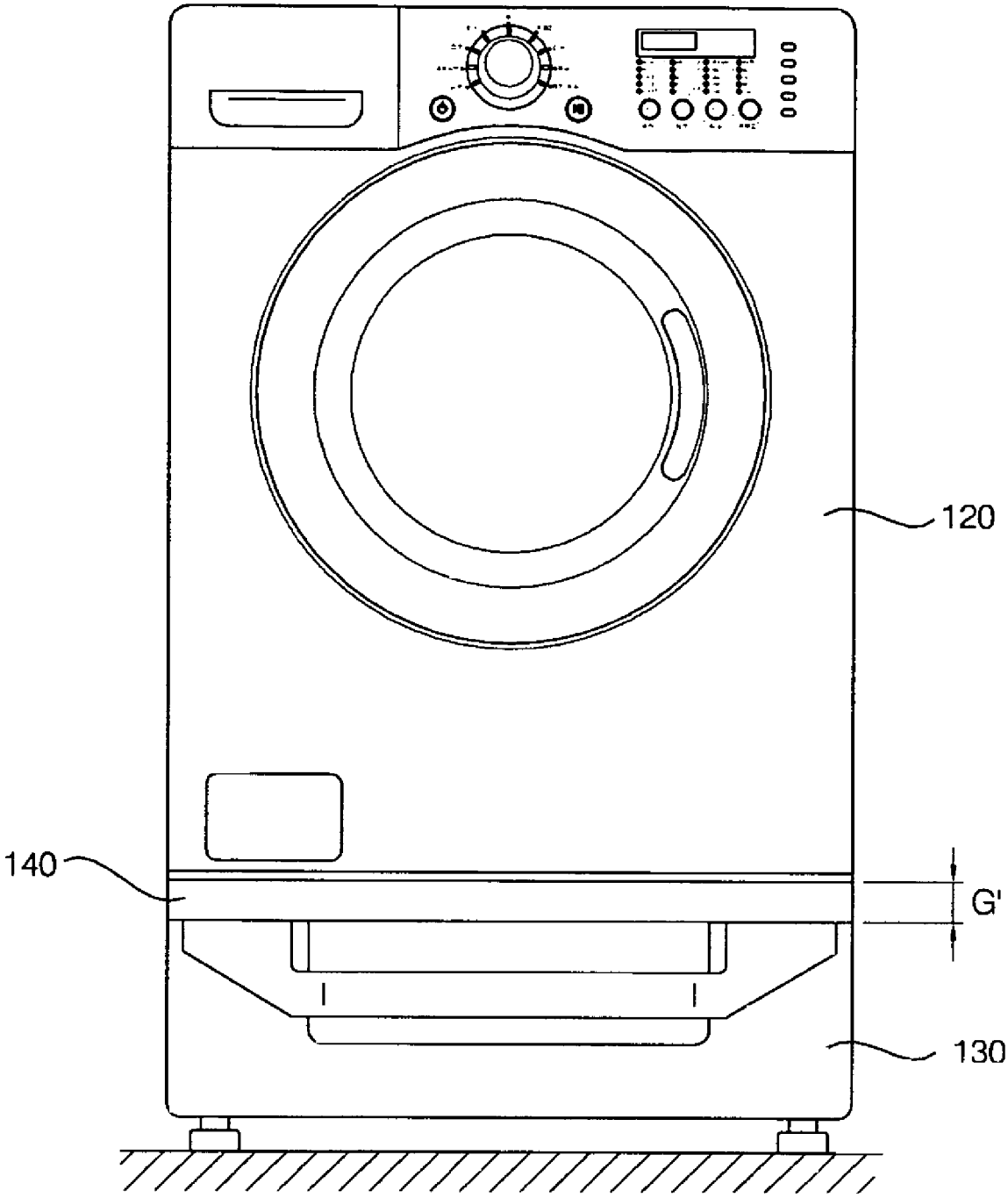
FIG. 10 is a front view of a laundry treatment apparatus according to a third embodiment of the present invention.
Figure 11:
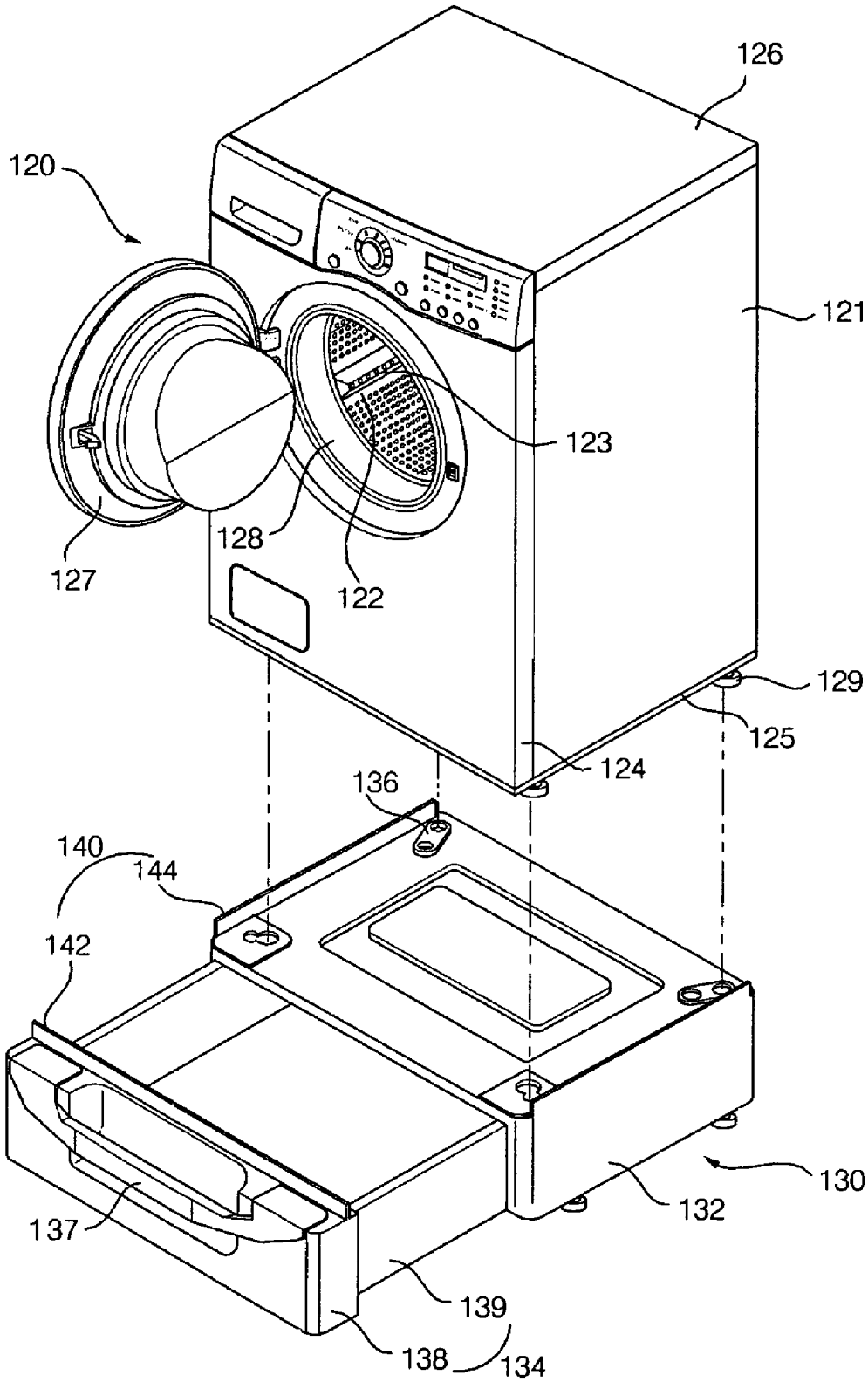
FIG. 11 is a dismantled perspective view of the laundry treatment apparatus according to a third embodiment of the present invention.

FIG. 10 is a front view of a laundry treatment apparatus according to a third embodiment of the present invention. FIG. 11 is a dismantled perspective view of the laundry treatment apparatus according to a third embodiment of the present invention.

The laundry treatment apparatus according to a third embodiment of the present invention includes a laundry treatment apparatus main body 120, a pedestal 130 for containing a variety of articles, and shield means disposed between the laundry treatment apparatus main body 120 and the pedestal 130, for shielding a gap G' between the laundry treatment apparatus main body 120 and the pedestal 130.

The laundry treatment apparatus main body 120 may be any one of a washing machine, a drying machine, and a combination dry and washing machine. The pedestal 130 may be disposed at any one of a left surface, a right surface, a top surface, and a bottom surface of the laundry treatment apparatus main body 120.

Hereinafter, in the third embodiment of the present invention, it is assumed that the pedestal 130 is disposed below the laundry treatment apparatus main body 120 and the laundry treatment apparatus main body 120 is the washing machine. That is, after the pedestal 130 is seated at a place in which the laundry treatment apparatus will be installed, the washing machine 120 is disposed on a top surface of the pedestal 130.

In this case, the washing machine 120 includes a cabinet 121 forming an external appearance, a tub (not shown) horizontally disposed within the cabinet 121, for containing water, a drum 122, which is disposed pivotally within the tub and contains polluted fabric, a plurality of lifters 123 disposed on an inner surface of the drum 122, for drawing up the fabric so that the fabric can drop from a predetermined height by the gravity, and a motor (not shown) disposed at the rear of the tub, for rotating the drum 122. A plurality of through holes through which water and/or bubbles can pass are formed at the outer surface of the drum 122.

A cabinet cover 124 is mounted on the entire surface of the cabinet 121. A base 125 is installed at the bottom of the cabinet 121. A top plate 126 is disposed on a top surface of the cabinet 121.

In the cabinet cover 124 are formed an inlet port through which the fabric can enter the drum 122, a door 127 for opening and shutting the inlet port. A gasket 128 for mitigating the shock by the rotation of the drum 122 and also serving to prevent water from overflow externally is installed between the tubs.

Height control legs 129 that support the weight of the washing machine 120 and also control the height are installed at four corners of the base 125.

The height control legs 129 are screwed with the base 125. Accordingly, when the height control legs 129 rotate in one direction, they are projected from the base 125, thereby increasing the height of the washing machine 120. Meanwhile, when the height control legs 129 rotate in the other direction, they are inserted into the base 125, thereby decreasing the height of the washing machine 120.

Furthermore, the pedestal 130 includes a housing 132 of a box shape, which has a width on which the washing machine 120 can be placed, and a drawer 134 disposed at the front of the housing 132 for containing a variety of articles within the housing 132.

The housing 132 and the drawer 134 are formed of a plastic material through ejection.

Seated units 136 in which the height control legs 129 of the washing machine 120 are seated and fixed respectively are disposed at the four upper corners of the housing 132. The height control legs 129 that support the loads of the washing machine 120 and the pedestal 130 and control the height of the pedestal 130 are disposed at the four lower corners of the housing 132.

The drawer 134 includes a front side 138 disposed at the front of the housing 132, wherein a handle 137 is formed at the front side 138, and a container 139 disposed at the rear of the front side 138, for containing a variety of articles, wherein the container 139 can be drawn from the housing 132.

Accordingly, the pedestal 130 can serve as not only a support of the washing machine 120, but also a container for containing a variety of articles, such as a detergent, tanning products, a whitener, repair tools, and cleaning tool, which are necessary to use the washing machine 120.

Meanwhile, the shield means is a shield rib 140 projected upwardly along the top edge of the pedestal 130 so that the gap G' between the pedestal 130 and the washing machine 120 can be shielded.

The shield rib 140 is formed integrally with the pedestal 130 through ejection. The shield rib 140 includes a front shield rib 142 formed at the front upper side of the pedestal 140 so that the front gap between the washing machine 120 and the pedestal 130 can be shielded, and lateral shield ribs 144 formed at upper both sides of the pedestal 130, respectively, so that the lateral gap G' between the washing machine 120 and the pedestal 130 can be shielded.

As described above, the front shield rib 142 and the lateral shield ribs 144 are projected to have a height in which the interference with the bottom surface of the base 129 of the washing machine 120 does not occur. That is, the shield rib 140 may be preferably formed to have the same height as that of the gap G' between the washing machine 120 and the pedestal 130 when the height control legs 129 of the washing machine 120 is projected to have the lowest height.

An installation process and operation of the laundry treatment apparatus constructed above according to the third embodiment of the present invention will be described below.

The pedestal 130 is installed at the installation place of the laundry treatment apparatus. The washing machine 120 is disposed on the pedestal 130.

At this time, in a state where the height control legs 129 of the washing machine 120 and the pedestal 130 are adjusted to a predetermined height, the washing machine 120 is disposed on a top surface of the pedestal 130. The height control legs 129 of the washing machine 120 are then seated in the seated units 136 of the pedestal 130.

An overall height of the laundry treatment apparatus is decided by the height control legs 129 of the washing machine 120 and the height control legs 129 of the pedestal 130. In a state where the washing machine 120 is disposed on the top surface of the pedestal 130, the height of the laundry treatment apparatus can be adjusted by controlling the height control legs 129 of the pedestal 130 rather than the washing machine 120.

Meanwhile, after the washing machine 120 is disposed on the top surface of the pedestal 130, the gap G' between the washing machine 120 and the pedestal 130 is shielded by the front shield rib 142 and the lateral shield ribs 144 formed on the upper side of the pedestal 130.

Therefore, the height control legs 129 of the washing machine 120 is not seen through the gap G' between the washing machine 120 and the pedestal 130. This can improve the togetherness of the washing machine 120 and the pedestal 130.

More particularly, if the front shield rib 142 and the lateral shield ribs 144 are formed at the front and both sides of the washing machine 120 in the same shape and then disposed on the same plane, the beauty of the laundry treatment apparatus can be further increased.

The front shield rib 142 and the lateral shield ribs 144 can minimize a phenomenon in which foreign substance is accumulated on the gap G' between the washing machine 120 and the pedestal 130, but also can prevent pollutants of fabric due to foreign substance accumulated on the gap G'.

In other words, although a part of the fabric is extended up to the gap G' while the fabric is inserted and drawn into and from the inlet port of the washing machine 120, the contact between the extended part of the fabric and foreign substance of the gap G' can be prevented by the shield rib 140.

Figure 12:
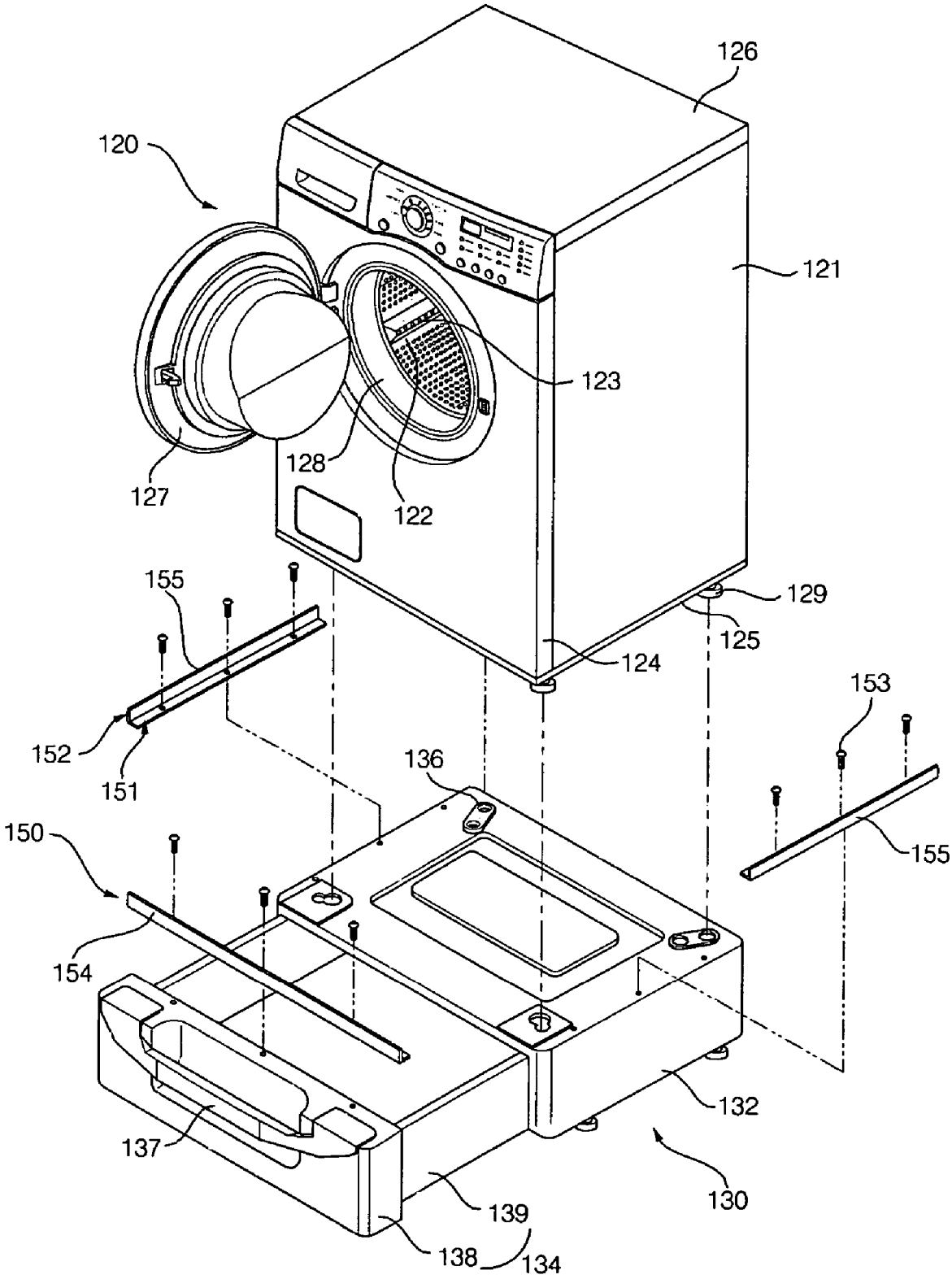
FIG. 12 is a dismantled perspective view of a laundry treatment apparatus according to a fourth embodiment of the present invention.

FIG. 12 is a dismantled perspective view of a laundry treatment apparatus according to a fourth embodiment of the present invention.

The same reference numbers will be used to refer to the same parts as those of the first embodiment and description thereof will be omitted.

In the laundry treatment apparatus according to a fourth embodiment of the present invention, shield means is a shield panel 150 disposed at an upper side of a pedestal 130, for shielding a gap G'between the pedestal 130 and a washing machine 120, as shown in FIG. 12. The remaining constituent elements are the same as the above-mentioned embodiment.

The shield panel 150 includes a fixed part 151 fastened to the upper corners of the pedestal 130, and a shield unit 152 disposed vertically to the gap G' between the pedestal 130 and the washing machine 120.

In more detail, the shield panel 150 includes the fixed part 151 and the shield unit 152 so that it has a L-shaped cross section. The fixed part 151 is fastened on the pedestal 130 by means of a fastening member 153. The shield unit 152 is disposed vertically in up and down directions along the gap G' between the pedestal 130 and the washing machine 120.

The shield panel 150 constructed above includes a front shield panel 154 disposed at the front side of the pedestal 130, for shielding a front gap G' between the washing machine 120 and the pedestal 130, and lateral shield panels 155 disposed at both sides of the pedestal 130, for shielding a lateral gap G' between the washing machine 120 and the pedestal 130, respectively.

The shield unit 152 of the front shield panel 154 and the lateral shield panels 155 are projected in a height in which interference with the bottom of the washing machine 120 is not generated. That is, the shield unit 152 may be preferably formed to have the same height as that of the gap G' between the washing machine 120 and the pedestal 130 when the height control legs 129 of the washing machine 120 have the lowest height.

Accordingly, the laundry treatment apparatus of the fourth embodiment may have the shield panel 150 including the shield unit 152 having an adequate height depending on the size of the gap G' between the washing machine 120 and the pedestal 130. Even when the size of the gap G' between the washing machine 120 and the pedestal 130 is varied depending on the capacity and installation condition of the laundry treatment apparatus, there is an advantage in that the gap G' can be completely shielded by the shield panel 150.

Although the laundry treatment apparatus of the present invention has been described with reference to the illustrated drawings, it is to be understood that the invention is not limited to the disclosed embodiments, but can be modified in various manners by those skilled in the art within the spirit and scope of the appended claims.

That is, the laundry treatment apparatus of the present invention may be applied to not only the drying machine and the combination dry and washing machine, but a dishwasher, and the shield means may have a variety of shapes.

The laundry treatment apparatus constructed above according to the embodiments of the present invention has the following advantages.

As described above, the laundry treatment apparatus according to an embodiment of the present invention includes the shield means that shields the gap between the plurality of laundry treatment apparatus main bodies and the gap between the laundry treatment apparatus main body and the pedestal. Accordingly, there is an advantage in that the market quality can be enhanced since the togetherness and beauty of products are improved.

Furthermore, the shield means disposed between the plurality of laundry treatment apparatus main bodies includes the fixed part that fixes the laundry treatment apparatus main body disposed on an upper side. Accordingly, there is an advantage in that the laundry treatment apparatus main body can be fixed stably.

In addition, the shield means disposed between the plurality of laundry treatment apparatus main bodies includes the shield unit for shielding the gap between the plurality of laundry treatment apparatus main bodies. The shield unit has the same height as that of the gap. Accordingly, there is an advantage in that the installation stability can be enhanced since the shield unit serves to support the laundry treatment apparatus main body disposed on an upper side.

Furthermore, the shield means disposed between the laundry treatment apparatus main body and the pedestal also serves to support the laundry treatment apparatus main body. Accordingly, there is an advantage in that the installation stability of the laundry treatment apparatus main body can be enhanced.

In addition, a phenomenon in which foreign substance is accumulated on the gap can be prevented. Accordingly, there is an advantage in that a phenomenon in which fabric is polluted by foreign substance accumulated on the gap can be prevented.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A laundry treatment apparatus, comprising:

a plurality of laundry treatment apparatuses disposed one on top of another; and a stacking kit disposed between the plurality of laundry treatment apparatuses, wherein the stacking kit comprises:

a fixed part disposed on a top surface of a lower laundry treatment apparatus to prevent the movement of an upper laundry treatment apparatus located at an upper side of the lower laundry treatment apparatus; and a shield unit provided in the fixed part for shielding a gap between the plurality of laundry treatment apparatuses, wherein the fixed part comprises:

left and right fixed parts disposed at upper right and left sides of the lower laundry treatment apparatus to prevent the right and left movements of the upper laundry treatment apparatus, each of the left and right fixed parts including a horizontal panel mounted at a top plate of the lower laundry treatment apparatus; and a front-side fixed part disposed at an upper front side of the lower laundry treatment apparatus to prevent the front direction movement of the upper laundry treatment apparatus, wherein the shield unit comprises:

an upward curved part curved upward from an outer end of the horizontal panel; and a downward curved part curved downward from an upper end of the upward curved part.

2. The laundry treatment apparatus as claimed in claim 1, wherein each of the plurality of laundry treatment apparatuses comprises a washing machine in which fabric is washed, and a drying machine disposed on a top surface of the washing machine, for drying wet fabric.

3. The laundry treatment apparatus as claimed in claim 1, wherein the shield unit is a front shield unit provided in the front-side fixed part, for shielding a front gap between the plurality of laundry treatment apparatuses.

4. The laundry treatment apparatus as claimed in claim 1, wherein the shield unit is a plate-type member formed to have the same height as that of the gap between the plurality of laundry treatment apparatuses.

5. The laundry treatment apparatus as claimed in claim 1, wherein the shield unit is disposed on the same plane as that of an outer surface of the plurality of laundry treatment apparatuses.

6. The laundry treatment apparatus as claimed in claim 1, wherein the downward curved part is extended downward from the horizontal panel.

* * * * *